US007877033B2

(12) United States Patent
Shibuya

(10) Patent No.: US 7,877,033 B2
(45) Date of Patent: Jan. 25, 2011

(54) IMAGE FORMING APPARATUS

(75) Inventor: Ken-ichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 210 days.

(21) Appl. No.: 12/334,780

(22) Filed: Dec. 15, 2008

(65) Prior Publication Data

US 2009/0162086 A1 Jun. 25, 2009

(30) Foreign Application Priority Data

Dec. 20, 2007 (JP) ..... 2007-329279

(51) Int. Cl.
*G03G 15/16* (2006.01)
*G03G 15/24* (2006.01)

(52) U.S. Cl. ..... 399/66; 399/149

(58) Field of Classification Search ..... 399/66, 399/71, 148, 149, 129
See application file for complete search history.

(56) References Cited

U.S. PATENT DOCUMENTS 5,034,777 A 7/1991 Ohzeki et al.
5,450,180 A 9/1995 Ohzeki et al.
6,744,994 B2 * 6/2004 Yoshikawa et al. ..... 399/129
2002/0057925 A1 5/2002 Watanabe et al.
2004/0005158 A1 1/2004 Okubo et al.

FOREIGN PATENT DOCUMENTS

JP 2704277 B2 5/1990
JP 2614317 B2 2/1997
JP 2002-99176 A 4/2002
JP 2003-316202 A 11/2003

* cited by examiner

*Primary Examiner*—Susan S Lee
(74) *Attorney, Agent, or Firm*—Fitzpatrick, Cella, Harper & Scinto

(57) ABSTRACT

There is provided an image forming apparatus, including: a image bearing member; a charging member; a developing device; a transfer member that forms a transfer portion, thereby transferring a toner image on the image bearing member, to a transfer material; a first toner charging member disposed on the lower stream side of the transfer portion and on the upper stream side of the charging member in a rotating direction of the image bearing member, thereby charging the toner on the image bearing member by applying voltage; wherein the developing device develops the electrostatic latent image and recovers the toner charged by the first toner charging member, the image forming apparatus further including: a first current detecting portion that detects a current value flowing through the first toner charging member; and a changing portion that changes a transfer condition according to the detected current value.

9 Claims, 9 Drawing Sheets

TRANSFER RESIDUAL TONER IN CASE OF TONER CHARGE AMOUNT OF -45 μC/g

RE-TRANSFER TONER OF M→C IN CASE OF TONER CHARGE AMOUNT OF -45 μC/g

TRANSFER RESIDUAL TONER IN CASE OF TONER CHARGE AMOUNT OF -25 μC/g

RE-TRANSFER TONER OF M→C IN CASE OF TONER CHARGE AMOUNT OF -25 μC/g

IMAGE FORMING APPARATUS

BACKGROUND OF THE INVENTION

1. Field of the Invention

The present invention relates to an image forming apparatus using an electrophotographic system, such as a copying machine, a printer, and a facsimile machine.

2. Description of the Related Art

Conventionally, in an image forming apparatus, toner left on a photoreceptor after transfer step is removed from the surface of the photoreceptor (image bearing member) by a cleaner, and remained in the cleaner to become a waste toner. However, from the point of environmental preservation and effective use of resources, it is desirable to prevent such a waste toner from being generated.

Therefore, in recent years, a "cleanerless system" image forming apparatus has been put to practical use, which is so designed that the cleaner is eliminated, then transfer residual toner on the photoreceptor is removed from the photoreceptor by "cleaning simultaneous with developing" by means of a developing device, and the removed toner is recovered by the developing device and reused.

In the cleaning simultaneous with developing, in the following developing step of the transfer residual toner on the photoreceptor after transfer, namely subsequently the photoreceptor is charged and exposed to form an electrostatic latent image. The transfer residual toner that exists on a part of the photoreceptor (non-image portion) which should not be developed by toner is recovered into the developing device by a fog removing bias in the process of the developing step of the electrostatic latent image. The fog removing bias means a fog removing potential difference Vback, being a potential difference between a DC voltage applied to the developing device and the surface of the photoreceptor.

According to this system, the transfer residual toner is recovered by the developing device and reused for the development of the electrostatic latent image in the following step. Therefore, the waste toner can be eliminated, with less trouble in maintenance. In addition, the apparatus is formed in the cleanerless system, and this contributes to reducing a size of the image forming apparatus.

In the above-described conventional image forming apparatus of cleaning simultaneous with developing, there is the one using a contact electrostatic charger, with a charger for charging the photoreceptor abut on the photoreceptor to apply charging process to the surface of the photoreceptor. In this case, when the transfer residual toner on the photoreceptor is passed through a charging portion, being a contact nip portion between the photoreceptor and the contact electrostatic charger, the toner is stuck to the contact electrostatic charger, with particularly a charge polarity in the transfer residual toner charged in an opposite-polarity opposite to a normal polarity. Thus, beyond an allowable range of the contact electrostatic charger is stained by toner, thereby causing a charging defect.

Namely, the toner, with the charge polarity charged reverse opposite to a normal polarity, is mixed in the toner as a developer, although little in amount. In addition, even in a case of the toner with charge polarity charged in the normal polarity, under an influence of a transfer bias and a separating discharge, the charge polarity is sometimes reversed or deelectrified, resulting in small charge amount.

Accordingly, the toner with the charge polarity charged in the normal polarity, reversal toner charged in the opposite-polarity opposite to the normal polarity, and the toner with little charge amount, are mixed in the transfer residual toner.

The reversal toner and the toner with little charge amount are easily stuck to the contact electrostatic charger, when passing through the charging portion, being the contact nip portion between the photoreceptor and the contact electrostatic charger.

In addition, in order to remove/recover the transfer residual toner on the photoreceptor by the cleaning simultaneous with developing of the developing device, the charge polarity of the transfer residual toner on the photoreceptor must be the normal polarity, the toner in this case being passed through the charging portion and conveyed to the developing portion. Also, the charge amount in this case must be the charge amount of the toner whereby the electrostatic latent image of the photoreceptor can be developed by the developing device. It is impossible to remove/recover the reversal toner and the toner with inappropriate charge amount into the developing device from the surface of the photoreceptor, resulting in a cause of an image defect.

As described above, and as described in Japanese Patent Application Laid-Open No. 2002-99176, the transfer residual toner is charged in the normal polarity by a toner charging member, to arrange charging polarities in the normal polarities, and also the charge amount is made uniform. Thus, the toner can be prevented from sticking to the contact electrostatic charger.

However, the transfer residual toner, to which the charge is imparted by the toner charging member to prevent the toner from sticking to the contact electrostatic charger, has a greater charge amount than that of the toner capable of developing the electrostatic latent image of the photoreceptor. Therefore, this toner is hardly removed/recovered by the cleaning simultaneous with developing in the developing device. In this case, the toner remained in the photoreceptor is overlapped on the next image (recovery ghost), thus causing the image defect.

In order to prevent such an image defect, another toner charging member is installed on the upper stream side of the toner charging member along a rotation direction of the photoreceptor, thereby applying charging processing of charging in the opposite-polarity opposite to the normal polarity, to the transfer residual toner, and the charge amount of the transfer residual toner is controlled. Thus, the charge amount of the transfer residual toner can be controlled, then recovery of the toner by the developing device can be efficiently performed, and image staining due to recovery failure can be reduced.

However, when a residual toner amount after transfer is increased, toner amount accumulated in the toner charging member is increased, and the control of the charge amount of the transfer residual toner becomes unstable. Therefore, as described in Japanese Patent Application Laid-Open No. 2003-316202, a method of ejecting a stained transfer residual toner from the toner charging member to the photoreceptor by utilizing the potential difference between the photoreceptor and the toner charging member, is known.

Meanwhile, in the transfer step, a transfer condition in the transfer step is set so that a highest possible amount of toner on the photoreceptor is transferred, namely so that transfer efficiency is increased. A conventional transfer condition is determined corresponding to a resistance fluctuation of a transfer member. Meanwhile, the transfer efficiency is fluctuated according to a state of the toner developed on the photoreceptor. For example, when charge amount of the developed toner is small, the toner amount on the photoreceptor is hardly transferred, thus deteriorating the transfer efficiency. Reversely, when the charge amount of the developed toner is excessively great, the transfer efficiency is similarly deteriorated.

Therefore, in a structure of setting the transfer condition from the fluctuation of the transfer member, without taking into consideration the state of the developed toner, fluctuation of the transfer efficiency occurs. When the residual toner amount after transfer is increased, the toner amount accumulated in the toner charging member is increased, and the control of the charge amount by the toner charging member easily becomes unstable. With a high ejecting frequency, the toner amount accumulated in the toner charging member can be decreased. However, further efficient technique is desired.

SUMMARY OF THE INVENTION

In order to solve the above problems, a typical configuration of an image forming apparatus according to the present invention has the following configuration in which there are included: a rotatable image bearing member; a charging member that charges the image bearing member; a developing device that develops an electrostatic latent image formed by exposure by means of toner; a transfer member that forms a transfer portion, thereby transferring a toner image on the image bearing member, to a transfer material, by applying transfer bias; a first toner charging member disposed on the lower stream side of the transfer portion and on the upper stream side of the charging member in a rotating direction of the image bearing member, thereby charging the toner on the image bearing member by applying voltage; wherein the developing device develops the electrostatic latent image and recovers the toner charged by the first toner charging member, the image forming apparatus further including: a first current detecting portion that detects a current value flowing through the first toner charging member; and a changing portion that changes a transfer condition according to a current value detected by the first current detecting portion.

According to the present invention, high transfer efficiency can be obtained.

Further features of the present invention will become apparent from the following description of exemplary embodiments with reference to the attached drawings.

DESCRIPTION OF THE EMBODIMENTS

First Embodiment

A first embodiment of an image forming apparatus according to the present invention will be described by using the drawings.

[Image Forming Apparatus]

Figure 1:
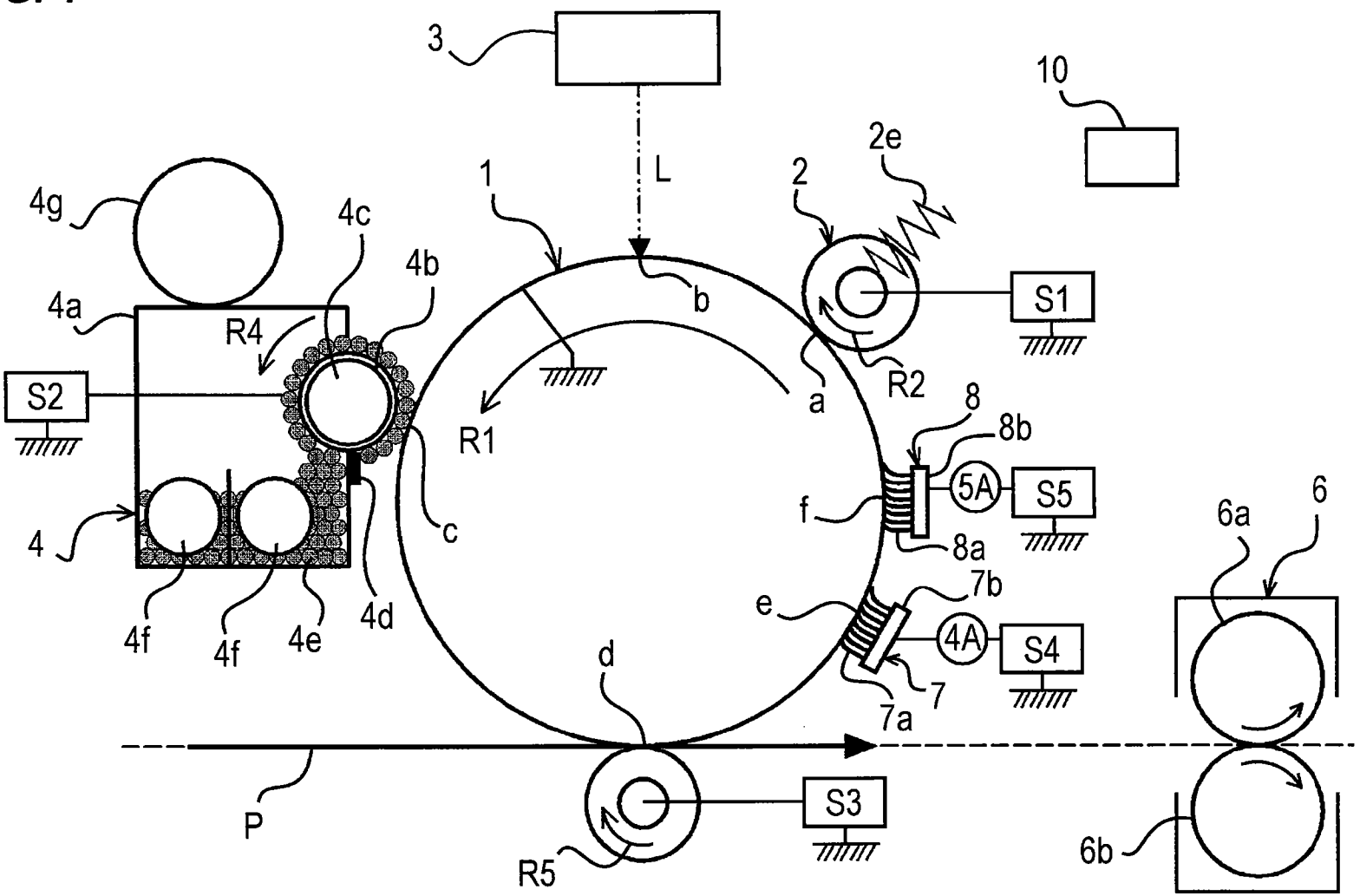
FIG. 1 is a schematic block diagram of an image forming apparatus according to an embodiment of the present invention.

FIG. 1 is a schematic block diagram illustrating an essential part of the image forming apparatus according to this embodiment. The image forming apparatus of this embodiment is the image forming apparatus of an electrophotographic system, such as a cleanerless system, such as laser printer, by cleaning simultaneous with developing, being a contact electrostatic charger system.

This image forming apparatus has a rotatable electrophotographic photoreceptor of a rotary drum type (called a photosensitive drum hereafter) 1 as a first image bearing member. A charging roller (charging member) 2, a developing device 4, a transfer roller (transfer member) 5 as a contact transfer member, and developer charge amount controlling members 7 and 8 are disposed along a rotation direction (counter-clockwise direction) of the photosensitive drum 1. An exposure apparatus (exposure unit) 3 is installed in the upper part between the charging roller 2 and the developing device 4. In addition, a fixing device 6 is provided on the lower stream side of a transfer portion d formed between the photosensitive drum 1 and the transfer roller 5 in a conveying direction of a transfer material.

Figure 2:
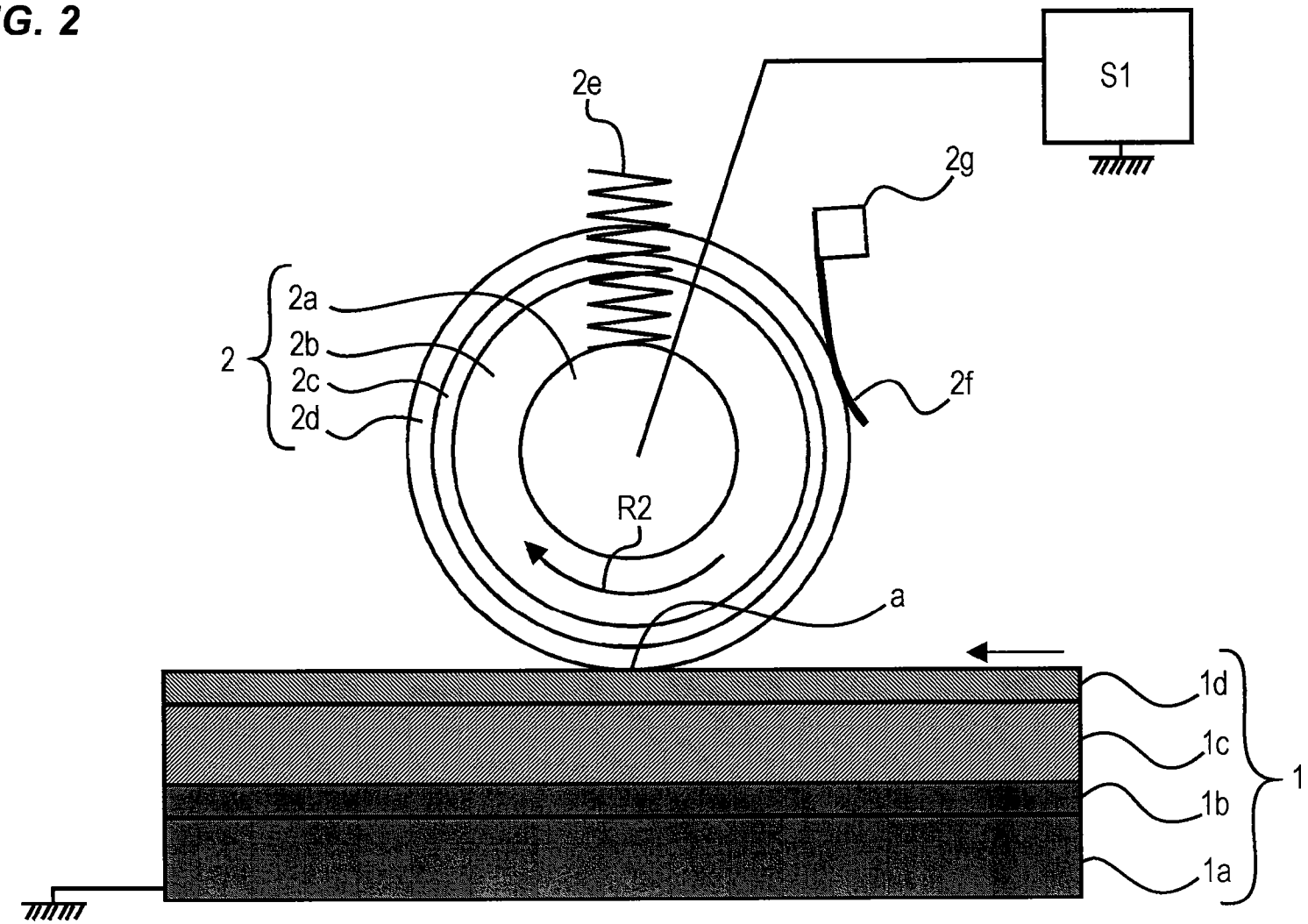
FIG. 2 is a sectional view of a photosensitive drum and a charging roller.

The photosensitive drum 1 is a negative charging type organic photoreceptor (OPC) having an outer diameter of 30 mm in this embodiment, and is driven to rotate in a direction illustrated by arrow (counter-clockwise direction) at a process speed (peripheral speed) of 210 mm/sec by a drive of a driving device (not illustrated). As illustrated in FIG. 2, the photosensitive drum 1 is constituted by sequentially applying three layers to the surface of a cylinder made of aluminum (conductive drum base member) 1*a* from below, three layers being an undercoating layer 1*b* for suppressing interference of light and enhancing adhesion between the undercoating layer and an upper layer thereof; a photocharge generating layer 1*c*; and a charge transport layer 1*d*.

The charging roller 2, with both end portions of a core metal 2*a* rotatably held by a bearing member (not illustrated), is energized toward the center of the photosensitive drum 1 by a pressing spring 2*e* and is in contact with the surface of the photosensitive drum 1 under pressure by a predetermined pressing force. Thus, the charging roller 2 is rotated following a rotary drive of the photosensitive drum 1. A press-contact portion between the photosensitive drum 1 and the charging roller 2 is a charging portion (charging nip portion) a.

By applying a charging bias voltage to the core metal 2*a* of the charging roller 2 under a predetermined condition by a power source S1, the peripheral surface of the photosensitive drum 1 is subjected to contact charge processing to predetermined polarity and potential. In this embodiment, the charging bias voltage applied to the charging roller 2 is an oscillating voltage in which a DC voltage (Vdc) and an AC voltage (Vac) are superposed on each other. More specifically, this is the oscillation voltage in which the DC voltage (−500 V) and the AC voltage (frequency: 2 kHz, inter-peak voltage: 1.4 kV) are superposed on each other, and the peripheral surface of the photosensitive drum 1 is subjected to contact charge processing uniformly and is charged to −500 V (dark potential Vd).

In addition, a longitudinal length of the charging roller 2 is set at 320 mm, and as illustrated in FIG. 2, a three-layer structure is provided, in which a lower layer 2*b*, an intermediate layer 2*c* and a surface layer 2*d* are successively laminated on the outside of the core metal (support member) 2*a* from beneath. The lower layer 2*b* is a foaming sponge layer for reducing a charging sound, and even if there is a defect such as pin hole generated on the photosensitive drum 1, the surface layer 2*d* serves as a protective layer for preventing a generation of leakage.

More specifically, specification of the charging roller 2 according to this embodiment is as follows.

Core metal 2*a*; stainless round bar with 6 mm in diameter.

Lower layer 2*b*; foaming EPDM wherein carbon is dispersed, specific gravity is 0.5 g/cm$^3$, volume resistance value is $10^2$ to $10^9$ Ωcm, layer thickness is 3.0 mm.

Intermediate layer 2*c*; NBR based rubber wherein carbon is dispersed, volume resistance value is $10^2$ to $10^5$ Ωcm, and layer thickness is 700 μm.

Surface layer 2*d*; tin oxide and carbon are dispersed in composite resin of fluorine compound, volume resistance value is $10^7$ to $10^{10}$ Ωcm, surface roughness (10 points average surface roughness Ra based on JIS standard) is 1.5 μm, and layer thickness is 10 μm.

In addition, a film-like charging roller cleaning member 2*f* having flexibility is provided on the surface of the charging roller 2 so as to be abutted thereon, for cleaning the surface of the charging roller 2. The cleaning member 2*f* is disposed in parallel to the longitudinal direction of the charging roller 2, with one end fixed to a support member 2*g* that performs a fixed amount of driving reciprocating motion in the longitudinal direction, so that a contact nip is formed between the cleaning member 2*f* and the charging roller 2 on the surface of the charging roller 2 closed to a free end side of the cleaning member 2*f*. Then, the support member 2*g* performs a fixed amount of reciprocating motion in the longitudinal direction of the charging roller 2 through a gear train by means of a driving device not illustrated. By the reciprocating motion, the surface of the charging roller 2 is rubbed by the cleaning member 2*f*. Thus, appropriate quantities of electric charge of the normal polarity can be supplied to the transfer residual toner adhered to the surface of the charging roller 2 again, and this transfer residual toner can be returned to the surface of the photosensitive drum 1.

The exposure apparatus 3 is a laser beam scanner using a semiconductor laser in this embodiment. The exposure apparatus 3 outputs laser beams modulated so as to correspond to an image signal input from a host processing such as an image reading device not illustrated, and a charge-processed surface of the photosensitive drum 1 is uniformly subjected to scan-exposure (image exposure) L at an exposure position b. By this scan-exposure L, the potential is decreased at a part on the surface of the photosensitive drum 1 irradiated with the laser beams. Whereby, electrostatic latent images (electrostatic images) corresponding to the image information that has undergone scan-exposure L are sequentially formed on the surface of the photosensitive drum 1.

The developing device 4 is a reverse developing device of a two-component magnetic brush developing system in this embodiment. The developing device 4 forms a toner image in such a manner that the toner is stuck to an exposure portion (bright portion) on the surface of the photosensitive drum 1, and the electrostatic image is reversely developed. The developing device 4 has a rotatable non-magnetic developing sleeve 4*b* including a fixed magnet roller 4*c* in an opening portion of a developing container 4*a* containing a developer. The surface of the developing sleeve 4*b* is thinly coated by a regulating blade 4*d* with a developer (toner) 4*e* of the developing container 4*a*, and the developer is then conveyed to a developing portion c opposed to the photosensitive drum 1. The developer 4*e* in the developing container 4*a* includes the toner and a magnetic carrier, and is conveyed to the developing sleeve 4*b* side while being uniformly stirred by the rotation of two developer stirring members 4*f*.

The resistance of the magnetic carrier in this embodiment is about $10^{13}$ Ωcm, and a particle size is 40 μm, and the toner is charged in negative polarity by friction caused by rubbing with the magnetic carrier. In addition, the toner density in the developing container 4*a* is detected by, for example, an optical toner density sensor (not illustrated), and based on this detection information, the developing container 4*a* is replenished with appropriate quantities of toner from a toner hopper 4*g*, and the toner density is adjusted to be constant. Namely, a toner replenishing portion for replenishing the development device from the toner hopper performs toner replenishment so that the toner density of the developer approaches a target value. A ratio of the toner and the developer (magnetic carrier+toner) (toner/developer, called T/D ratio hereafter) is controlled to be set at 8% as T/D ratio by the toner density sensor, for maintaining the charge amount (electric charge amount) to be constant. Namely, a toner density target value in this case is 8%. Upper limit of this T/D ratio is set at 10%, and lower limit thereof is set at 6%. In the T/D ratio of the upper limit or more, the toner amount that can be charged by friction is more increased, with respect to a carrier in the developing device, thus allowing the toner to scatter from the developing device. Also, in the case of the T/D ratio of the lower limit or less, the toner amount in the developing device is decreased, thus making it difficult to develop a required image density. The T/D ratio of 8% is an intermediate point between the upper limit and the lower limit. Details of the control will be described later.

The developing sleeve 4*b* and the photosensitive drum 1 are arranged close to and facing each other, with a closest distance between the developing portion c and the photosensitive drum 1 maintained to be 300 μm, and the developing sleeve 4*b* is driven to rotate in the opposite direction to the rotating direction (counter clockwise direction) of the photosensitive drum 1 in the developing portion c.

A predetermined developing bias is applied to the developing sleeve 4*b* from a power source S2. In this embodiment, the developing bias voltage applied to the developing sleeve 4*b* is an oscillation voltage in which the DC voltage (Vdc) and the AC voltage (Vac) are superposed on each other. More specifically, the developing bias voltage in this case is the oscillation voltage in which the DC voltage (−350 V) and the AC voltage (inter-peak voltage 2 kV) are superposed on each other.

The transfer roller (transfer member) 5 abuts on the photosensitive drum 1 with a predetermined pressure and total pressure 1 kg in this embodiment, to form a transfer portion d, and a transfer bias (transfer bias of positive polarity, being an opposite-polarity opposite to the negative polarity, being the normal charge polarity of the toner) is applied from a power source S3. Thus, a toner image (developer image) on the surface of the photosensitive drum 1 is transferred to a transfer material P such as a paper sheet as a second image bearing member by the transfer portion d.

In the transfer roller 5, variation in resistance at the time of manufacture is hardly suppressed, and the resistance is changed by changes in temperature and humidity and degradation in durability. Therefore, a transfer high voltage power source has a controlling member capable of performing constant voltage control and constant current control and a member that detects voltage and current at this time. The constant current control of the transfer bias is performed in a sate in which the image is not formed on the photosensitive drum 1 when the previous rotation is carried out for image formation. Charged potential of the photosensitive drum 1 at this time and an optimal transfer voltage for the resistance value of the transfer roller 5 are detected, and the constant voltage control is performed using the transfer voltage previously obtained when the image is transferred. Namely, the transfer voltage is determined so as to obtain a target transfer current desired to be flown when the image transfer is performed, and the image transfer operation is performed using this determined transfer voltage. The control method thus described is also illustrated in Japanese Patent No. 02614317 and Japanese Patent No. 2704277.

Figure 9:
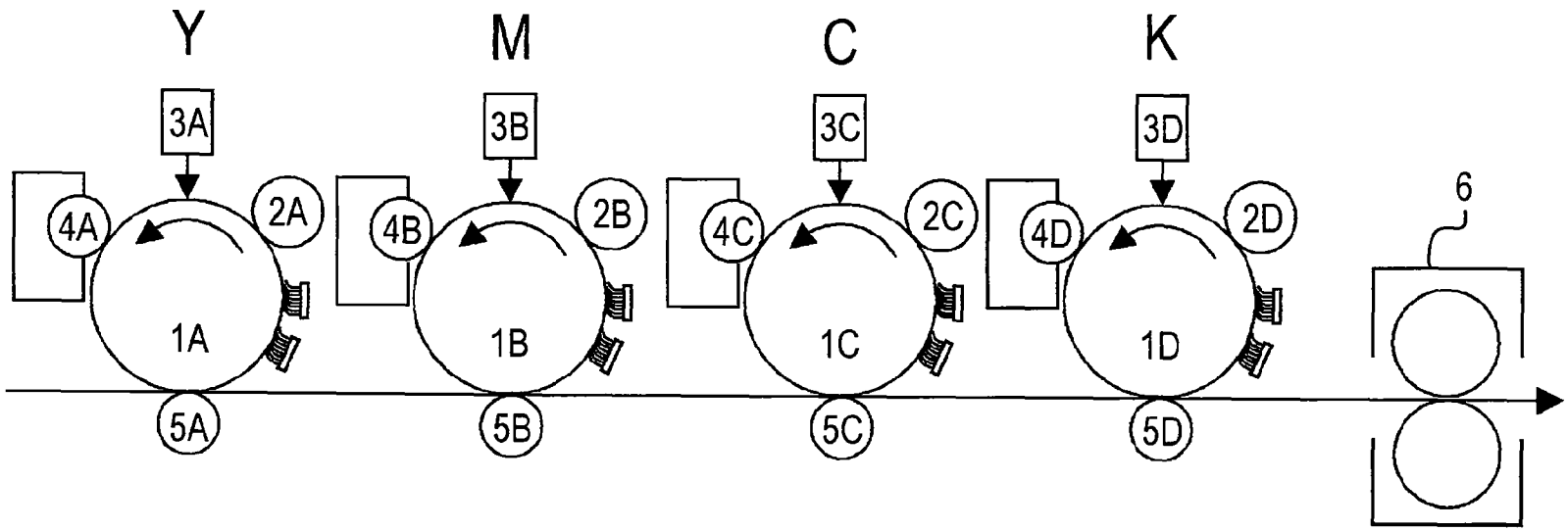
FIG. 9 is schematic block diagram of a color image forming apparatus.

FIG. 9 illustrates an example of the color image forming apparatus used as a multiple transfer system in the image forming apparatus of FIG. 1. As illustrated in FIG. 9, four process units, being image forming units, are provided in the color image forming apparatus so as to correspond to each color of Y, M, C, K. The color image forming apparatus has photosensitive drums 1A to 1D, charging rollers 2A to 2D, exposure apparatuses 3A to 3D, developing devices 4A to 4D, and transfer rollers 5A to 5D, so as to correspond to each color.

In this embodiment, a target transfer current value of the transfer roller 5 is set in a range from lower limit 12 μA to upper limit 16 μA.

When the transfer current value is the upper limit or more, the toner is easily charged in the positive polarity (+) opposite to the opposite-polarity at the transfer portion. In the image forming apparatus for performing multiple transfer, a phenomenon called "re-transfer" frequently occurs, in which the toner image prepared in a certain image forming station and transferred to a transferred member is returned to the image bearing member in the following image forming station. When this phenomenon occurs, there are problems such as an uneven image and deterioration of density, and deviation in color balance. In a cleanerless system, the toner from the image forming station on the upper stream side is recovered by the developing device of the image forming station of a different color on the lower stream side, thus involving a serious problem such as a mixed color of the toner.

When the transfer current value is the lower limit or less, a sufficient electric field, which is necessary for peeling off the toner from the photosensitive drum 1, is not generated, and as a result, density deterioration of the image occurs. The transfer current value 14 μA is the intermediate point between the upper limit and the lower limit.

The fixing device 6 has a fixing roller 6*a* and a pressure roller 6*b* which are rotatable. The toner image transferred to the surface of a transfer material P is heat-fixed thereto by being heated and pressurized, while conveying the transfer material P in a state of being nipped by the fixing nip portion between the fixing roller 6*a* and the pressure roller 6*b*.

The toner charging members 7 and 8 have brush type members 7*a* (first member) and 8*a* (second member) having proper conductivity respectively, and support members 7*b* and 8*b* for supporting them. The brush type members 7*a* and 8*a* are brought into contact with the surface of the photosensitive drum 1, in contact portions e and f. The toner charging members 7 and 8 apply DC voltage or DC and AC superposed voltages to the photosensitive drum 1 in the upper stream side in the rotation direction R1 of the image bearing member 1 than the charging roller 2, and in the lower stream side in the rotation direction R1 of the image bearing member 1 than the transfer roller 5.

[Image Forming Operation]

Next, an image forming operation by the image forming apparatus will be described by using FIG. 1.

At the time of the image formation, the photosensitive drum 1 is rotary-driven at a predetermined peripheral speed in a direction R1 illustrated by arrow (counter clockwise direction) by the driving device (not illustrated), and the surface is uniformly charged by the charging roller 2 rotated in a direction R2 which is the same direction as a traveling direction of the surface of the photosensitive drum 1 to which the above charging bias is applied.

Then, a scan-exposure L is implied to the surface of the charged photosensitive drum 1 by the exposure apparatus 3, and the electrostatic latent image according to the input image information is formed. Then, the toner charged in the same polarity as the charge polarity (negative polarity) of the photosensitive drum 1 is stuck to the electrostatic image formed on the photosensitive drum 1 by the developing sleeve 4*b* in the developing portion c, and the image is developed as the toner image (reverse development).

When the toner image on the photosensitive drum 1 reaches the transfer portion d between the photosensitive drum 1 and the transfer roller 5 rotated in a direction R5 which is the same direction as the traveling direction of the surface of the photosensitive drum 1, a registration roller (not illustrated) conveys the transfer material P to the transfer portion d at this timing.

Then, by an electrostatic force generated between the photosensitive drum 1 and the transfer roller 4, the toner image on the photosensitive drum 1 is transferred to the transfer material P conveyed to the transfer portion d by the transfer roller 5 to which the transfer bias of the opposite-polarity (positive polarity) opposite to the polarity of the above toner is applied. The transfer material P, to which the toner image is transferred, is conveyed to the fixing device 6, and heated and pressurized in the fixing portion between the fixing roller 6*a* and the pressure roller 6*b*, then the toner image is heat-fixed thereto, and is discharged to outside, thus completing a series of image forming operation.

In addition, the transfer residual toner remained on the surface of the photosensitive drum 1 after transfer of the toner image, reaches the developing portion c through the charging portion a and the exposure portion b, with the rotation of the photosensitive drum 1. Then, at the time of development after the following step, the transfer residual toner is recovered by a fog removing bias (cleaning simultaneous with development) at the developing sleeve 4*b* of the developing device 4. Here, the fog removing bias means a fog removing potential difference Vback, being the potential difference between the DC voltage applied to the developing sleeve 4*b* and the surface potential of the photosensitive drum 1. The recovered transfer residual toner (residual developer) is used after the following step, and thereby a waste toner can be eliminated.

In the developing portion c, the developing sleeve 4*b* is rotated in the direction R4 opposite to the traveling direction of the surface of the photosensitive drum 1. This is advantageous in the recovery of the transfer residual toner on the photosensitive drum 1. In addition, since the transfer residual toner on the photosensitive drum 1 passes through the exposure portion b, and therefore the exposure step is performed to the transfer residual toner. However, there is only a small amount of the transfer residual toner, and therefore no great influence appears.

Figure 3:
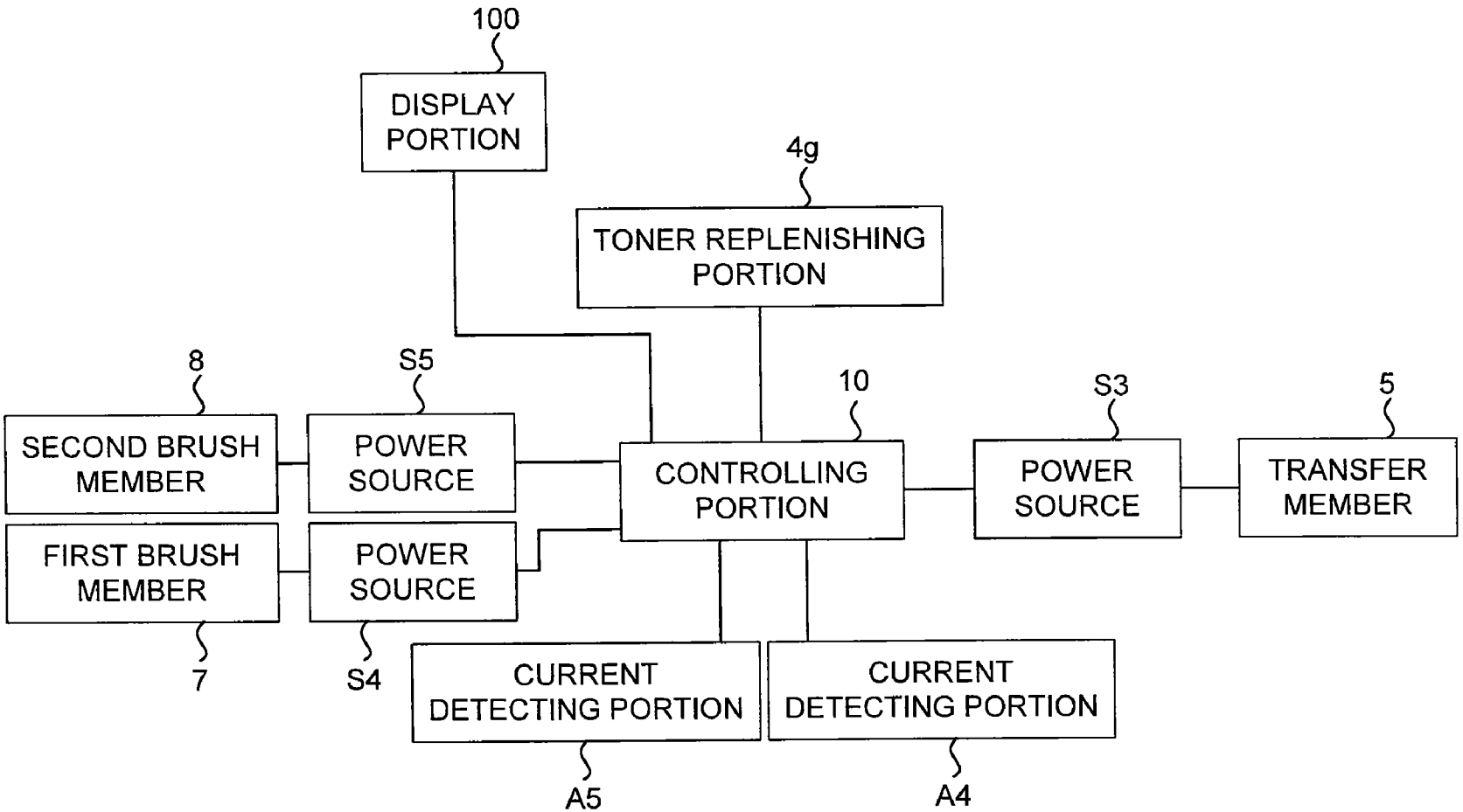
FIG. 3 is a block diagram of this example.

Here, the block diagram according to this example will be described by using FIG. 3. First, a controlling portion (CPU) 10 has functions of controlling a power source for applying voltage to an image forming portion and changing the transfer condition according to a detected current value detected by a current detecting portion. Also, the controlling portion 10 controls the power source S3 for applying voltage to the transfer member 5. Further, similarly, the controlling portion 10 controls the power source S4 for applying voltage to the first brush member 7 and the power source S5 for applying voltage to the second brush member 8. Moreover, the controlling portion 10 controls the toner replenishing portion 4*g*. Then, output of a second current detecting portion A5 and output of a first current detecting portion A4 are input into the controlling portion 10. In addition, the controlling portion 10 outputs information to a display portion 100 for displaying the information.

[Image Defect]

Incidentally, as described above, the toner having the polarity charged in the normal polarity, and the toner charged in the opposite-polarity (reversal toner), and the toner having small charge amount, are mixed in the transfer residual toners. Out of them, when the reversal toner and the toner with small charge amount are passed through the charging portion a, the toner sticks to the charging roller 2, and an allowable range or more of the charging roller 2 is thereby stained by the toner, thereby causing an charging defect.

In addition, in order to effectively perform the cleaning simultaneous with developing of the transfer residual toner on the photosensitive drum 1 by using the developing device 4, the following matter is necessary. Namely, the charge polarity of the transfer residual toner on the photosensitive drum 1 conveyed to the developing portion c must be the normal polarity, and the charge amount must be the charge amount of the toner capable of developing the electrostatic latent image on the photosensitive drum 1 by the developing device 4. Note that the reversal toner and the toner with improper charge amount can not be removed/recovered from the photosensitive drum 1 to the developing device 4, thus causing a defective image to occur.

Further, with diversification of a use's needs of recent years, when a large quantity of transfer residual toner is generated at once, by a continuous image forming operation such as an image of high image proportion including an electrophotographic image, the transfer residual toner can not be removed/recovered from the photosensitive drum 1 to the developing device 4, thus causing the defective image to occur, in the same way as described above.

[Countermeasure Against the Image Defect]

Therefore, according to this embodiment, the first brush member 7, being a first toner charging member, and the second brush member 8, being a second toner charging member, are installed between the transfer portion d and the charging portion a. The first current detecting portion A4 detects current flowing through a first member 7*a* of the first toner charging member 7. The second current detecting portion A5 detects the current flowing through a second brush portion 8*a* of the second toner brush member 8.

The voltage of the opposite-polarity (normal polarity) opposite to a normal charge polarity of the toner is applied to the first brush portion 7*a* by a voltage applying power source S4. The voltage of the same polarity (negative polarity) as the normal charge polarity of the toner is applied to the second member 8*a* by a voltage applying power source S5. In this embodiment, +300 V is applied to the first member 7*a*, and −800 V is applied to the second member 8*a*.

The transfer residual toner remained on the surface of the photosensitive drum 1 after transferring the toner image, reaches a contact portion e between the first brush member 7 and the photosensitive drum 1, with the rotation of the photosensitive drum 1 in the direction R1 illustrated by arrow, and uniformly charged once in the normal polarity by the first brush member 7. In addition, a surface potential of the photosensitive drum 1 is set at a value near 0 V by the first brush member 7, to thereby surely perform discharge by the second brush member 8 positioned on the lower stream side in the rotating direction of the photosensitive drum 1.

The transfer residual toner on the surface of the photosensitive drum 1 uniformly charged in the normal polarity by the first brush member 7, reaches a contact portion f between the second brush member 8 and the photosensitive drum 1, with the subsequent rotation of the photosensitive drum 1 in the direction R1 illustrated by arrow. The transfer residual toner on the surface of the photosensitive drum 1 that reaches the contact portion, is uniformly charged in the negative polarity, being the normal polarity at the time of passing through the second brush member 8. In this embodiment, the charge amount of the transfer residual toner after passing through the second brush member 8 is −70 μC/g.

Next, recovery of the transfer residual toner in the developing step will be described.

As described above, the developing device 4 adopts the cleanerless system in which the transfer residual toner is cleaned simultaneously with development. The charge amount of the toner developed on the photosensitive drum 1 is −25 μC/g in this embodiment. Here, under the development condition in this embodiment (density of the developer in the developing device), table 1 shows a relation between the transfer residual toner and the charge amount for recovering the transfer residual toner into the developing device 4.

TABLE 1

| Charge amount (μC/g) | Recovery |
|---|---|
| −10.0 | Defect |
| −12.5 | Excellent |
| −15.0 | Excellent |
| −30.0 | Excellent |
| −40.0 | Excellent |
| −45.0 | Excellent |
| −50.0 | Defect |

The toner charge amount for recovering the transfer residual toner on the photosensitive drum 1 into the developing device 4 must be 0.5 to 1.8 times (−12.5 μC/g to −45 μC/g) the toner charge amount (−25 μC/g) at the time of development.

However, in order to prevent the toner from sticking to the charging roller 2 as described above, charge removal must be performed to recover the transfer residual toner by the developing device 4, the transfer residual toner being largely charged in the negative polarity such as −70 μC/g by the second brush member 8.

In order to apply charge processing to the surface of the photosensitive drum 1, AC voltage Vac (frequency f=2 kHz, and inter-peak voltage Vpp=1400 V) is applied to the charging roller 2. Therefore, the transfer residual toner is AC-deelectrified. In this embodiment, the toner charge amount after passing through the charging portion a is −30 μC/g.

Thus, in the developing step, the transfer residual toner on the photosensitive drum 1 can be recovered into the developing device 4.

Thus, the charge processing is performed while the charge amount of the transfer residual toner on the photosensitive drum 1, which is brought to the charging portion a from the transfer portion d, is uniformly set in the negative polarity (−), being the normal polarity, by the first brush member 7 and the second brush member 8. Also, the photosensitive drum 1 is charged in a predetermined potential by the charging roller 2, and simultaneously the charge amount of the transfer residual toner charged in the negative polarity, being the normal polarity, by the above second brush member 8, is controlled to a proper charge amount capable of developing the electrostatic latent image of the photosensitive drum 1 by the developing device 4. Thus, sticking of the transfer residual toner to the charging roller 2 can be suppressed. In addition, the recovery of the transfer residual toner in the developing device 4 can also be efficiently performed.

[Durability Experiment]

Figure 4:
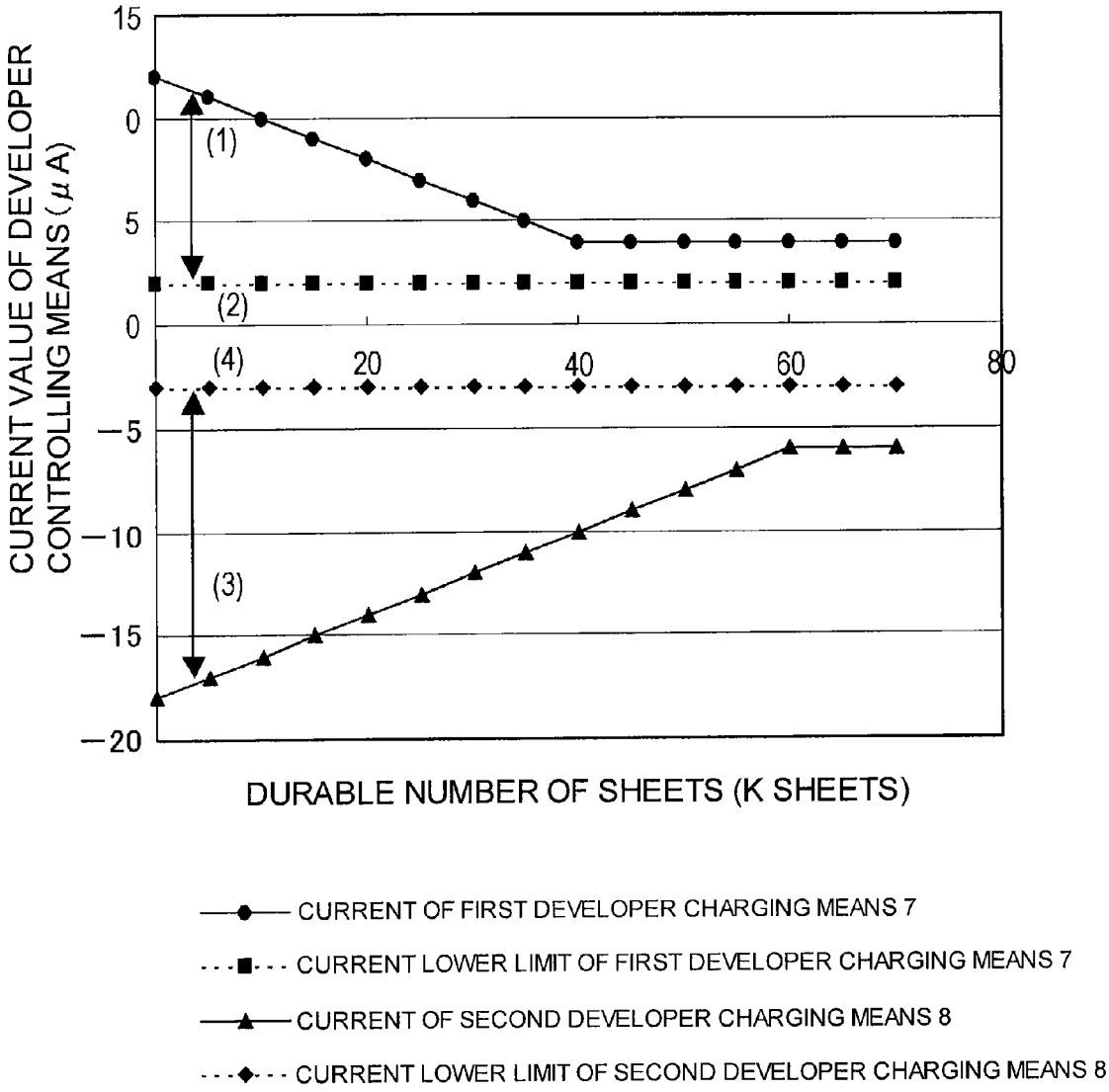
FIG. 4 is a view illustrating a transition of current flow amount of a developer charge amount controlling member with respect to the number of sheets of durable images.

FIG. 4 is a graph illustrating a current transition of the first brush member 7 measured by the first current detecting portion A4, at the time of performing continuously passing paper endurance of the image having 5% of image Duty (image ratio; recording area/transfer material area), and a current transition of the second brush member 8 measured by the second current detecting portion A5. At the time of this study, the target transfer current value of the transfer roller 5 is set at 14 μA. The voltage of the positive polarity is applied to the first brush member 7, and therefore when performing the continuously passing paper endurance, the current is decreased as illustrated in FIG. 4 under an influence of the stain of the transfer residual toner charged in the negative polarity. Also, the voltage of the negative polarity is applied to the second brush member 8, and therefore when performing the continuously passing paper endurance, the current is decreased as illustrated in FIG. 4 under an influence of the stain of the transfer residual toner charged in the positive polarity.

When the image having low image Duty (1% or less in this embodiment) withstands utilization for a long period of time, the toner amount consumed to the outside of the developing device is decreased, thus allowing rubbing to occur between the toner and the magnetic carrier in the developing device for a long period of time, resulting in high charge amount of the toner. When such a toner is developed, the toner can not be peeled off from the photosensitive drum 1 in the transfer portion, and the transfer residual toner is charged in high negative polarity (−), which is then accumulated in the first brush member 7 in large volume.

When the first brush member 7 is stained in large quantity, then increasing the resistance and making it difficult to flow the current, capability of charging the transfer residual toner in the positive polarity once is deteriorated, and the charging member is stained by the transfer residual toner, resulting in the image defect such as fog. In addition, in a case of such a low transferring capability, a defect such as decreasing the density of an original image also occurs.

The lower limit of an absolute value of a current value of the first bush member 7 at the time of generating the image defect is as illustrated in FIG. 4. When the current fluctuates in an area of FIG. 4(1), the above image defect does not occur. However, when the current fluctuates in an area of FIG. 4(2), the image defects such as fog and density decrease occur.

In addition, when the image having high image Duty (30% in this embodiment) withstands utilization for a long period of time, the turnover of the toner in the developing device is accelerated, then a rubbing time between the toner and the magnetic carrier is shortened, and the charge amount of the toner is decreased. When such a toner is developed, the voltage of the opposite-polarity opposite to that of the toner is applied in the transfer portion. Therefore, the charge amount of the toner is further decreased, and the toner is hardly scattered from the photosensitive drum along the electric field of the transfer member, resulting in allowing a large quantity of the transfer residual toner to be generated. In addition, the toner of particularly low charge amount is turned into the transfer residual toner of high charge amount, being the opposite-polarity (+), and a phenomenon called a re-transfer is liable to occur, in which the transfer residual toner is returned to the photosensitive drum 1 again. Such a transfer residual toner is accumulated in the second brush member 8 in large quantities.

When the second brush member 8 is stained in large quantity, then the resistance is increased and the current hardly flows, the capability of implying charge to the transfer residual toner is deteriorated, then the charging member is stained by the transfer residual toner, resulting in the image defect such as fog.

The lower limit of the absolute value of the current value of the second brush member 8 at the time of generating such an image defect, is as illustrated in FIG. 4. When the current fluctuates in an area of FIG. 4(3), the above image defect does not occur. However, when the image fluctuates in an area of FIG. 4(4), the image defect such as fog occurs.

Figure 5:
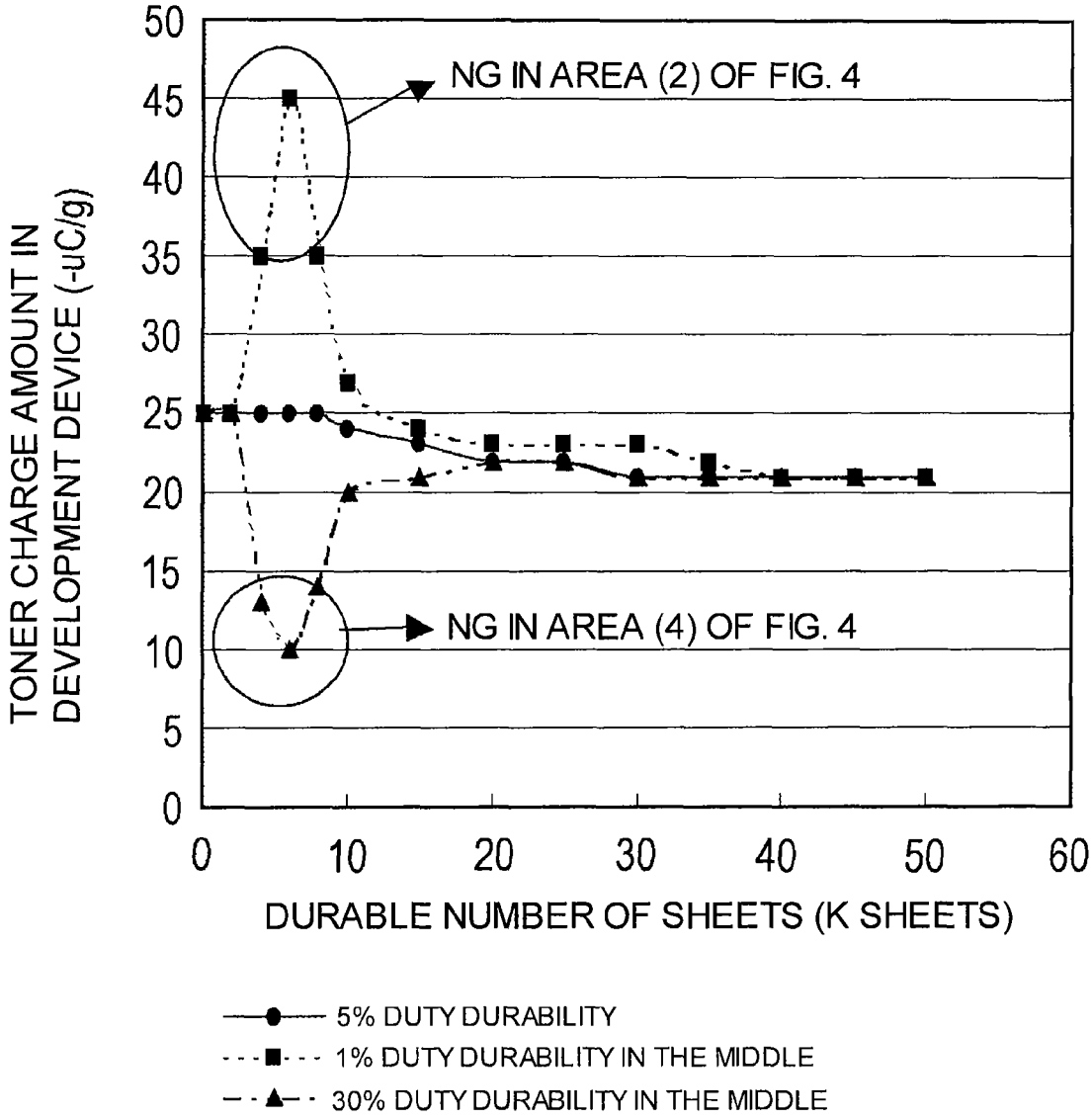
FIG. 5 is a view illustrating a transition of charged toner amount in a developing device with respect to the number of sheets of durable images.

FIG. 5 is a graph illustrating a change of the charge amount in the developing device in a case of a constant 5% image Duty durability, when the image Duty is changed from 5% image Duty in 3000 to 8000 number of durable sheets. As illustrated in FIG. 5, the image Duty is changed from 5% image Duty to low image Duty (1% image Duty) and high image Duty (30% image Duty). When the image of the low image Duty withstands utilization for a long period of time, the charge amount in the developing device is increased, and when the image of the high image Duty withstands utilization for a long period of time, the charge amount in the developing device is decreased, resulting in a large quantity of transfer residual toner.

When the voltage applied to the brush members 7 and 8 is set to be strong in advance, in anticipation of the image defect due to the increase of the transfer residual toner, stronger electric charge is implied to the transfer residual toner when the brush members 7 and 8 are not stained, and recovering the transfer residual toner into the developing device 4 become difficult.

Also, it may be also possible to perform control so that the voltage applied to the brush members 7 and 8 is changed by stain amount of the brush members 7 and 8, and is also changed by current amount flowing through them. However, when the brush members 7 and 8 are remarkably stained, the stain of the transfer residual toner stuck to the brush members 7 and 8 is not uniform, and this is not appropriate because there exists a place where the current hardly flows, being the place where originally the current easily flows.

The above image defect can be suppressed by controlling the amount of the transfer residual toner, so that the current amount flowing through the brush members 7 and 8 can be settled in a predetermined range. Hereinafter, specific explanation will be given for the control of the amount of the transfer residual toner. In this embodiment, each case of the control of the transfer residual toner amount by T/D ratio control in the developing device, and the control of the transfer residual toner amount by the control of changing the transfer condition, will be described.

[Control of Transfer Residual Toner Amount]

First, the control of the transfer residual toner amount by the T/D ratio control in the developing device will be described. It is so controlled that when the current value detected by the current detecting portions A4 and A5 is set to be a predetermined value or less, the T/D ratio (target value) in the developing device is changed.

Specifically, when the first current detecting portion A4 detects that the current value of the first brush member 7 is 3 μA or less just before the area of FIG. 4(2), it is so controlled that the T/D ratio in the developing device is set at 10% of the upper limit. Namely, the target value of the toner density (T/D ratio) is changed to be great. Such a control operation is performed by the controlling portion (CPU) 10. When the charge amount of the toner in the developing device is increased as described above, the first brush member 7 is remarkably stained and the current amount is decreased. Therefore, by changing the T/D ratio in the developing device from 8% of a center value to 10% of the upper limit, the toner amount is increased with respect to the amount of the magnetic carrier, then an opportunity of rubbing is decreased, and the increase of the charge amount of the toner can be alleviated.

In addition, it is so controlled that when the second current detecting portion A5 detects that the current value of the second brush member 8 is set at −4 μA or more just before the area of FIG. 4(4), the T/D ratio in the developing device is set at 6% of the lower limit. Namely, the target value of the toner density (T/D ratio) is changed to be small. Such a control operation is performed by the controlling portion (CPU) 10. When the charge amount of the toner in the developing device is decreased as described above, the second brush member 8 is remarkably stained and the current amount is decreased. Therefore, by changing the T/D ratio in the developing device from 8% of the center value to 6% of the lower limit, the toner amount is decreased with respect to the amount of the magnetic carrier, then the opportunity of rubbing is increased, and the decrease of the toner charge amount can be alleviated.

Incidentally, when the current value of the first brush member 7 is 3 μA or less just before the area of FIG. 4(2) or the second brush member 8 is −4 μA or more just before the area of FIG. 4(4), the brush members 7 and 8 is usually stained by toner in large quantities. Accordingly, when both of the absolute value of the current value flowing through the first brush member 7, and the absolute value of the current value flowing thorough the second brush member 8 are set at the lower limit value or less respectively, it is so determined that this case is abnormality of the image forming apparatus, and the user is notified of this matter. At that time, the image forming apparatus may not be operated.

Also, when the current values of the brush members 7 and 8 are returned to the areas of FIG. 4(1) and FIG. 4(3), the T/D ratio in the developing device is returned to original 8%. The T/D ratio is completely returned when it returns in a range of the graph illustrated by solid line in FIG. 4.

Figure 6:
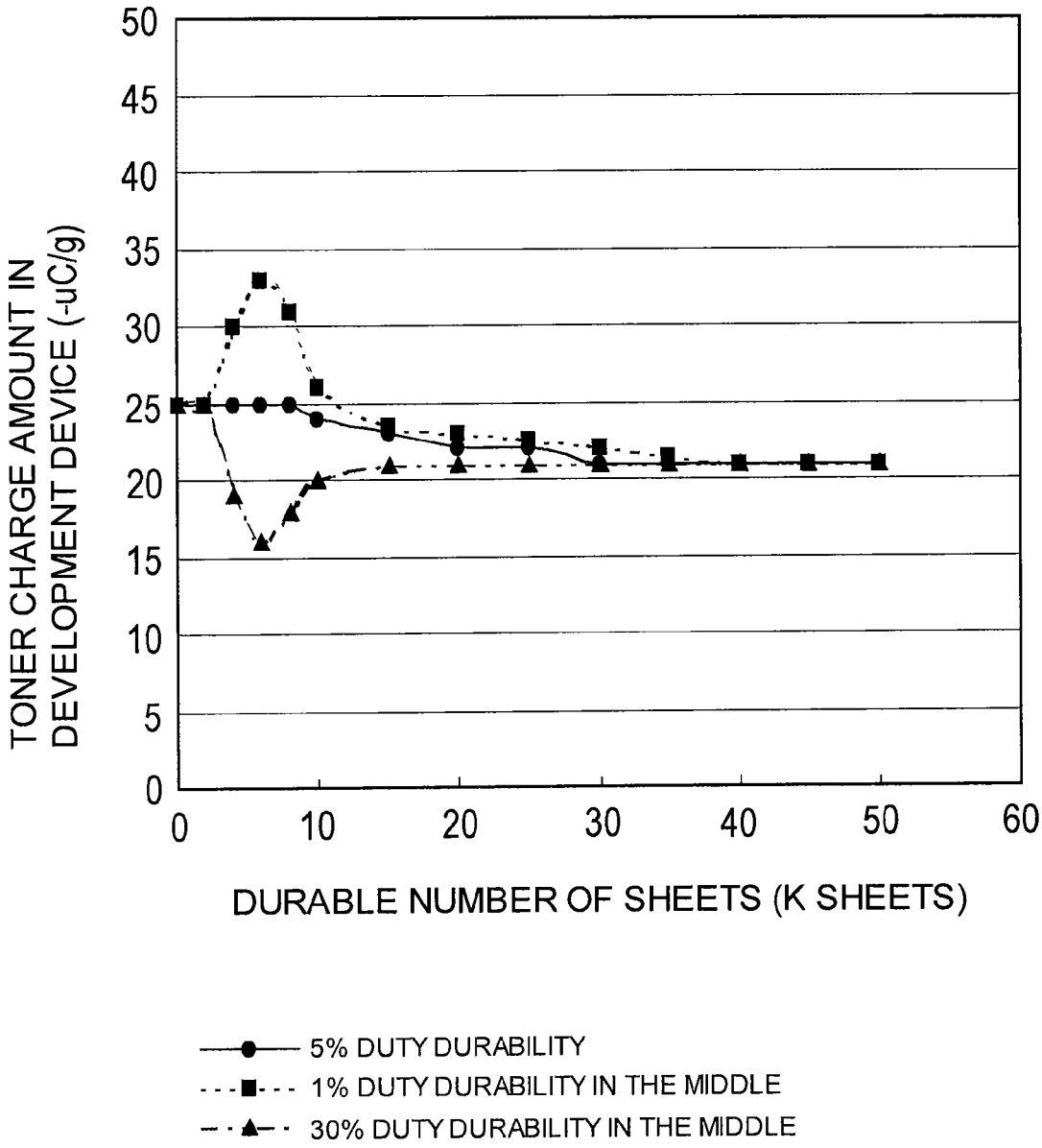
FIG. 6 is a view illustrating the transition of charged toner amount in the developing device with respect to the number of durable sheets of images, when control of T/D ratio is performed.

FIG. 6 is a graph illustrating the change of the charge amount in the developing device, when the above control of the T/D ratio is performed in the constant 5% image Duty durability and in the case that the image Duty is changed from the 5% image Duty in the number of durable sheets of 3000 to 8000. As illustrated in FIG. 6, the image Duty is changed from the 5% image Duty to the low image Duty (1% image Duty) and the high image Duty (30% image Duty).

As illustrated in FIG. 6, even if the image ratio is extremely decreased or increased in the middle, the charge amount of the toner in the developing device fluctuates within an optimal range (−12.5 μC/g to −45 μC/g), and the occurrence of the image defect can be suppressed.

With the above-described structure, even if various image Duties are continuously prepared, the charge amount of the toner in the developing device is settled within the optimal range. Thus, the transfer residual toner is decreased, and stains of the brush members 7 and 8 are also decreased, thus enabling to suppress the occurrence of the image defect such as fog due to the stain of the charging roller and maintain an excellent image.

[Control of Transfer Bias]

A structure of changing the T/D ratio in the developing device has been described in the above description. However, even if not using this structure, the transfer efficiency can be increased by the structure as will be described hereinafter. The image forming apparatus according to this embodiment is designed so that the value of the transfer bias, being the transfer condition, is controlled to be changed according to the current value detected by the current detecting portions A4 and A5. By changing the target transfer current value at the time of determining the transfer voltage, the transfer bias is changed.

Specifically, it is so controlled that when the first current detecting portion A4 detects that the current value of the first brush member 7 becomes 3 μA or less just before the area of FIG. 4(2), the target transfer current value is set at 16 μA, being the upper limit of the target transfer current value. Namely, the value of the transfer bias is changed to be great. Such a control operation is performed by a controlling member (CPU) 10. When the charge amount of the toner in the developing device is increased as described above, the first brush member 7 is extremely stained and the current amount is decreased. In order to transfer such a toner, the transfer bias is applied, being a stronger transfer current than a transfer current center set value. Thus, the toner is easily peeled off from the photosensitive drum 1 to the transfer member, and the transfer efficiency of the toner can be increased.

Also, it is so controlled that when the second current detecting portion A5 detects that the current value of the second brush member 8 becomes −4 μA or more just before the area of FIG. 4(4), the target transfer current value is set at 12 μA, being the lower limit. Namely, the value of the transfer bias is changed to be small. Such a control operation is performed by the controlling member (CPU) 10. When the charge amount of the toner in the developing device is decreased as described above, the second brush member 8 is extremely stained and the current amount is decreased. Namely, when such a toner is developed to the photosensitive drum 1, the toner is liable to be charged in the opposite-polarity, because the voltage of the opposite-polarity opposite to the polarity of the toner is applied in the transfer portion, and the toner is liable to be charged in the opposite-polarity and is re-transferred to the photosensitive drum 1. Therefore, the transfer bias, being a weaker transfer current than the transfer current center set value, is applied to such a toner. Thus, the toner is prevented from being charged in the opposite-polarity in the transfer portion.

Incidentally, when the current value of the first brush member 7 is 3 μA or less just before the area of FIG. 4(2) or the second brush member 8 is −4 μA or more just before the area of FIG. 4(4), the brush members 7 and 8 is usually stained by toner in large quantities. Accordingly, when both of the absolute value of the current value flowing though the first brush member 7, and the absolute value of the current value flowing through the second brush member 8 become the lower limit value or less, respectively, it is so determined that this is an abnormality case of the image forming apparatus, and the user is notified of this matter. Specifically, this information is displayed on the display portion for displaying the information. At that time, the image forming apparatus may not be operated.

In addition, when the current values of the brush members 7 and 8 are completely returned to the areas of FIG. 4(1) and FIG. 4(3), the target transfer current value is returned to original 14 μA.

Figure 7:
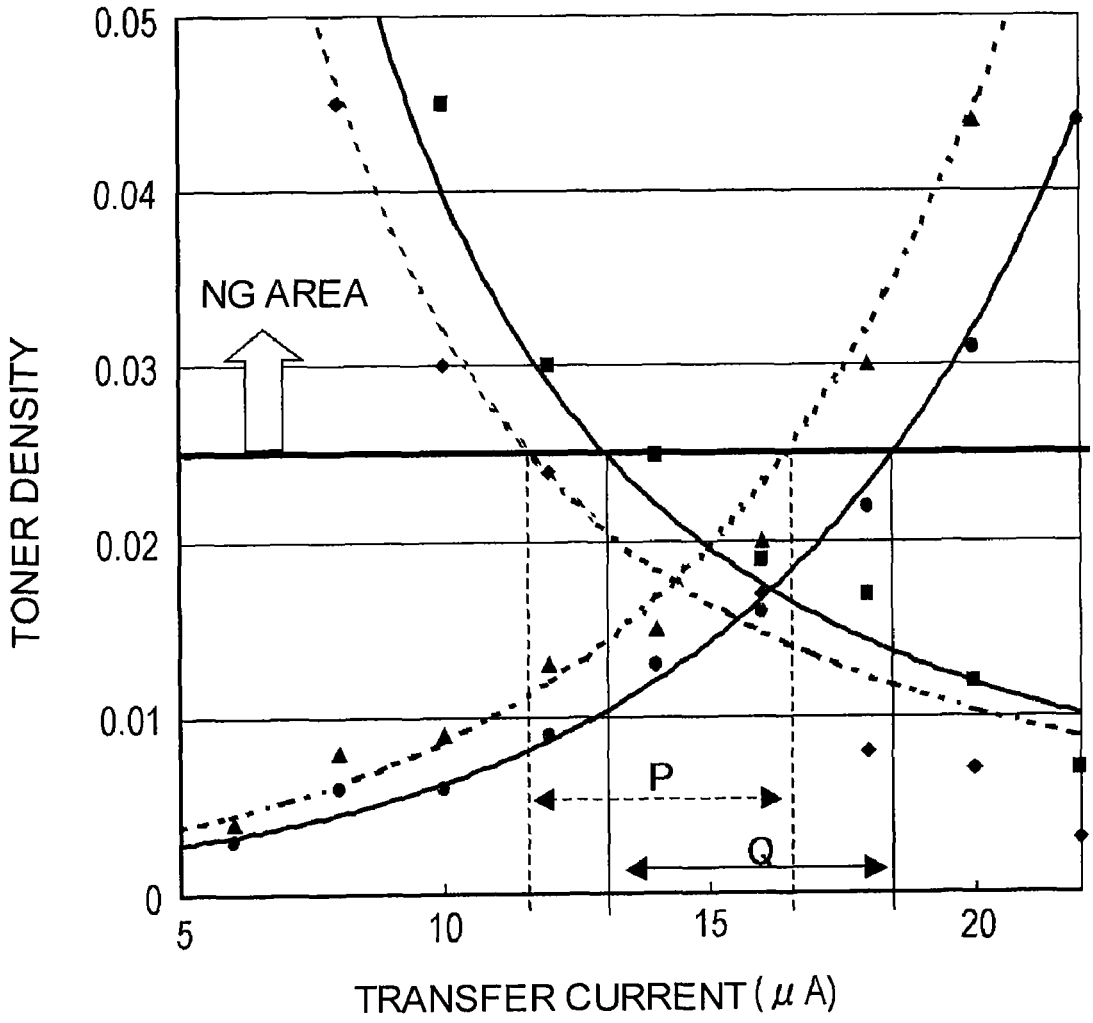
FIG. 7 is a view illustrating a relation between charged toner amount and a transfer residual toner density, and re-transfer toner density according to a second embodiment.

FIG. 7 is a view illustrating a relation between the toner charge amount and transfer residual toner density, and a re-transfer toner density, in a color image forming apparatus of multiple transfer system of FIG. 9.

As illustrated in FIG. 7, the transfer residual toner density of third image forming station C was measured, when the toner charge amount of each color was set at −45 μC/g. The re-transfer toner density to the third image forming station C from the second image forming station M was measured when the toner charge amount of each color was set at −45 μC/g. The transfer residual toner density of the third image forming station C was measured, when the toner charge amount of each color was set at −25 μC/g. The re-transfer toner density to the third image forming station C from the second image forming station M was measured when the toner charge amount of each color was set at −25 μC/g.

The toner density is obtained by measuring a reflection density (X-rite) by tape-peeling off the toner remained on the photosensitive drum 1. In this embodiment, when the toner density becomes 0.025 or more, the stains of the brush members 7 and 8 are extremely worsened, and the image defect such as fog is generated.

When the toner charge amount was set at −25 μC/g, the center value of a range P of the transfer current, in which no fog occurs, was 14 μA. When the toner charge amount was set at −45 μC/g, the center value of a range Q of the transfer current, in which no fog occurs, was 16 μC/g.

As the toner charge amount of the developer is increased, the current value necessary for peeling off the toner from the photosensitive drum 1 is also increased, and therefore a high transfer current is required. In addition, even if the transfer current is made high, the toner is hardly charged in the opposite-polarity (+), because an original toner charge amount is high, and the upper limit of the re-transfer is also shifted high.

Figure 8:
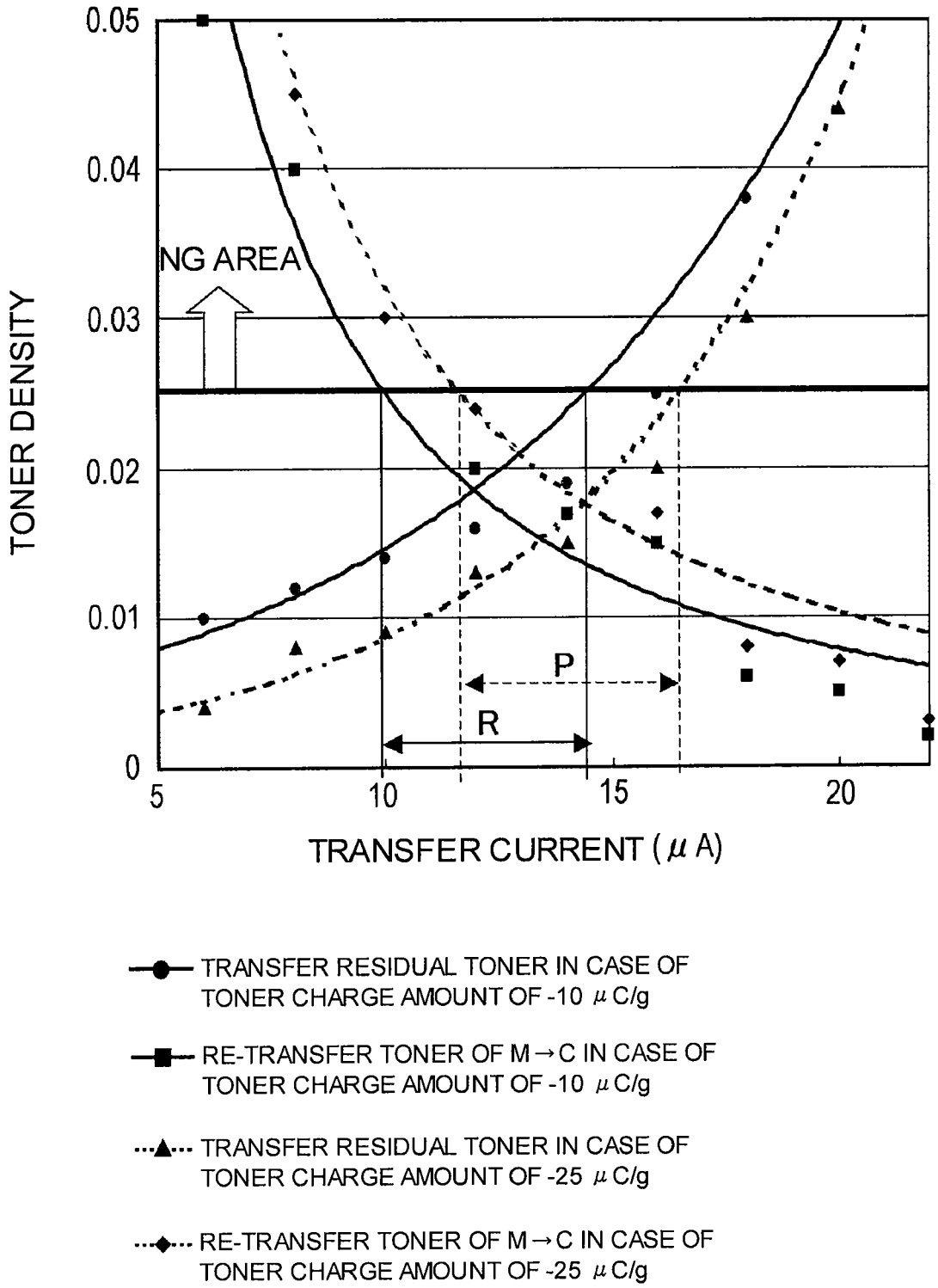
FIG. 8 is a view illustrating a relation between the charged toner amount and the transfer residual toner density, and the re-transfer toner density according to the second embodiment.

FIG. 8 is a view illustrating a relation between the toner charge amount and the transfer residual toner density, and the re-transfer toner density, in the color image forming apparatus of multiple transfer system of FIG. 9.

As illustrated in FIG. 8, the transfer residual toner density of the third image forming station C was measured when the toner charge amount of each color was set at −10 μC/g. The re-transfer toner density to the third image forming station C from the second image forming station M was measured when the toner charge amount of each color was set at −10 μC/g. The transfer residual toner density of the third image forming station C was measured when the toner charge amount of each color was set at −25 μC/g. The re-transfer toner density to the third image forming station C from the second image forming station M was measured when the toner charge amount of each color was set at −25 μC/g.

The center value of the range P of the transfer current, in which no fog occurs, was 14 μA when the toner charge amount was set at −25 μC/g. The center value in the range R of the transfer current, in which no fog occurs, was 12 μC/g when the toner charge amount was set at −10 μC/g.

As the toner charge amount of the developer is decreased, the toner is liable to be charged in the opposite-polarity (+), and the upper limit of the re-transfer is shifted low. Even if the transfer current is set low, it is easy to peel off the toner from the photosensitive drum 1, because the charge amount of the toner is low.

Thus, by adjusting the transfer current in an optimal range when the toner charge amount in the developing device is changed, the transfer residual toner and the re-transfer toner can be reduced, and the stains of the brush members 7 and 8 can be suppressed. As described above, by setting the transfer bias (transfer current) to be optimal by the current value detected by the current detecting portions A4 and A5, the occurrence of the image defect such as fog due to the stain of the charging roller can be suppressed, and the excellent image can be maintained.

Second Embodiment

Next, a third embodiment of the image forming apparatus according to the present invention will be described by using the drawings. The same signs and numerals are assigned to a part overlapped on the explanation of the above first embodiment, and explanation therefore is omitted.

The image forming apparatus according to this embodiment is obtained by combining a development countermeasure (change of a toner density target value) and a transfer countermeasure (control of the transfer bias). Based on the current value detected by the current detecting portions A4 and A5, either one of the developing condition of the developing device 4 and the transfer condition of the transfer roller 5 is preferentially selected and determined by a controlling portion 10 which is a selecting portion.

Specifically, when the current value of the first brush member 7 is set in the area of FIG. 4(2), the T/D ratio in the developing device is set from 8% to 10% as the development countermeasure, and the transfer set current is set from 14 μA to 16 μA as the transfer countermeasure. When the current value of the second brush member 8 is set in the area of FIG. 4(4), the T/D ratio in the developing device is set from 8% to 6% as the development countermeasure, and the transfer set current is set from 14 μA to 12 μA as the transfer countermeasure.

Table 2 shows the time required for the current value of a controlling member 7 to move from FIG. 4(2) to FIG. 4(1), and shows the time required for the current value of a controlling member 8 to move from FIG. 4(4) to FIG. 4(3).

TABLE 2

| | Time (s) required for developer charge amount controlling member 7 to move from (2) to (1) | Time (s) required for developer charge amount controlling member 8 to move from (4) to (3) |
|---|---|---|
| Development countermeasure | 60 | 240 |
| Transfer countermeasure | 240 | 30 |

The case in which the current value of the first brush member 7 is set in the area of (2), is the case in which the first brush member 7 is stained, and also is the case in which the toner charge amount in the developing device is high. When the toner charge amount is high, the image defect is caused by a transfer defect, and as is clarified from the table 2, as the counter measure, effects can be exhibited in a short time when the current value of the brush member is fed back to the transfer set current.

The case in which the current value of the second brush member 8 is set in the area of (4), is the case in which the second brush member 8 is stained, and also is the case in which the toner charge amount in the developing device is low. When the toner charge amount is low, fog occurs in the self-image forming station earlier than the re-transfer generated from the image forming station on the upper stream side, and as is clarified from the table 2, effects can be exhibited in a short time when the current value of the brush member is fed back to the T/D ratio in the developing device.

Therefore, in this embodiment, when the absolute value of the current value of the first brush member 7 becomes the lower limit (3 μA in this embodiment) or less, the current value of the brush member is fed back to the transfer set current first. Namely, the value of the transfer bias is set large. Then, if the absolute value of the current value does not exceed the lower limit even if a predetermined time (60 s) is elapsed after change of the value of the transfer bias, namely when the absolute value of the current value is not moved to the area of (1), the current value of the brush member is fed back to the T/D ratio in the developing device. Namely, the toner density target value of the developer is changed to be large.

Also, when the absolute value of the current value of the second brush member 8 becomes the lower limit (4 μA in this embodiment) or less, first, the current value of the brush member is fed back to the T/D ratio in the developing device. Namely, the toner density target value of the developer is changed to be small. Then, when the absolute value of the current value does not exceed the lower limit even if a predetermined time (30 s) is elapsed after change of the toner density target value, namely, when the absolute value of the current value is not moved to the area of (3), the current value of the brush member is fed back to the transfer set current. Namely, the value of the transfer bias is changed to be small.

The control operation as described above is performed by the controlling member (CPU) 10.

According to the above first embodiment, the current value of the brush member is fed back to the T/D ratio within the developing device, and according to the above second embodiment, the current value of the brush member is fed back to the transfer current set value. According to this embodiment, by combining the first embodiment and the second embodiment, priority is given to a feedback destination by the current values of the brush members 7 and 8. This enables to further shorten the time for improving the stain of the brush member. Thus, the occurrence of the image defect such as fog due to the stain of the charging roller can be suppressed, and the excellent image can be maintained.

[Other Structure]

According to each of the above embodiments, the first member 7 and the second member 8 are formed as brush type members. The first member 7 and the second member 8 may also be formed into arbitrary forms, such as a brush rotator, an elastic roller member, and a sheet type member.

Also, the T/D ratio, the set center of the transfer current value, the upper limit and the lower limit values are given as examples, and the T/D ratio and the set value of the transfer current are arbitrarily set, depending on the image forming apparatus, an environment, and a durability condition.

In addition, according to the above embodiment, the current value of the developer charge amount controlling member is fed back to the T/D ratio of the developing condition. However, it is also possible to feedback to other developing conditions such as a stirring time and a stirring speed of the developer.

Further, according to the above embodiment, although the current value of the developer charge amount controlling member is fed back to the transfer current set value of the transfer condition, it can also be fed back to other transfer conditions such as a pressure to the photosensitive drum of the transfer roller.

In addition, the photosensitive drum 1 may have a direct injection electrification performance including a charge injection layer having surface resistance of $10^9$ to $10^{14}$ Ω·cm. Even in a case that the charge injection layer is not used, similar effects can be obtained even if a charge transport layer, for example, is within the above resistance range. Further, it may also be possible to use an amorphous silicon photoreceptor, with volume resistance of a surface layer set at about $10^{13}$ Ω·cm.

Each of the above embodiments provides a structure in which the charging roller 2 is used as a flexible charging member. However, other than the charging roller 2, it is also possible to use the one having a shape/material of a fir brush, a felt, and a fabric. Further, by combining each kind of material, more appropriate elasticity, conductivity, surface flatness, and durability can be obtained.

Waveforms such as sine, rectangular, and triangular can be suitably used as a waveform of an AC voltage component (AC component, voltage with values are periodically changed) of an oscillation electric field, applied to the charging roller 2 and the developing sleeve 4*b* of each embodiment. Further, the AC voltage component may also be the rectangular wave formed by periodically turning on/off a DC power source.

In addition, in each of the above embodiments, the exposure apparatus 3 of a laser scanning unit is used as an exposure unit (information writing unit) to a charged surface of the photosensitive drum 1. However, other than this exposure apparatus 3, for example a digital exposure unit using a solid state light emitting element array such as an LED may also be used. Further, it is also possible to use an analog image exposure unit, with a halogen lamp and a fluorescent lamp, etc, set as an original illuminating light source.

In addition, in each of the above embodiments, the photosensitive drum is used as a first image bearing member. However, the image bearing member may also be an electrostatic recording dielectric material. In this case, after uniformly charging the surface of the electrostatic recording dielectric material, the charge of the surface is selectively removed by a charge removal member such as a charge removal needle and an electron gun, and the electrostatic latent image corresponding to target image information is written and formed.

In addition, in each of the above embodiments, a roller transfer using a transfer roller is adopted as a transfer member. However, other than the roller transfer, blade transfer, belt transfer, and other contact transfer charging system may be used, and a non-contact transfer charging system using a corona charger may also be used.

In addition, other than the means that performs direct transfer to a transfer member as illustrated in each of the above embodiments, the image forming apparatus for forming a monochromatic image or full color image by using an intermediate transfer member such as a transfer drum and a transfer belt may also be used. As described above, according to the present invention, irrespective of a state of the toner to be developed, it is possible to reduce sticking of the toner to a member for charging the toner on the image bearing member after transfer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-329279, filed Dec. 20, 2007, which is hereby incorporated by reference herein in its entirety.

What is claimed is:

1. An image forming apparatus, comprising:

a rotatable image bearing member;

a charging member that charges the image bearing member;

a developing device that develops an electrostatic latent image formed by exposure by means of toner;

a transfer member that forms a transfer portion, thereby transferring a toner image on the image bearing member, to a transfer material, by applying transfer bias;

a first toner charging member disposed on the lower stream side of the transfer portion and on the upper stream side of the charging member in a rotating direction of the image bearing member, thereby charging the toner on the image bearing member by applying voltage;

wherein the developing device develops the electrostatic latent image and recovers the toner charged by the first toner charging member, the image forming apparatus further including:

a first current detecting portion that detects a current value flowing through the first toner charging member; and a changing portion that changes a transfer condition according to a current value detected by the first current detecting portion.

2. The image forming apparatus according to claim 1, comprising:

a second toner charging member disposed on the lower stream side of the first toner charging member and on the upper stream side of the charging member in the rotating direction of the image bearing member, to which a voltage of opposite-polarity opposite to a polarity of the voltage applied to the first toner charging member is applied; and a second current detecting portion that detects a current value flowing through the second toner charging member.

3. The image forming apparatus according to claim 2, wherein the polarity of the voltage applied to the first toner charging member is a positive polarity, and the polarity of the voltage applied to the second toner charging member is a negative polarity.

4. The image forming apparatus according to claim 1, wherein when an absolute value of a current value detected by the first current detecting portion is below a previously set value, the changing portion changes the transfer condition so that a current flowing through the transfer member is increased.

5. The image forming apparatus according to claim 2, wherein when an absolute value of a current value detected by the second current detecting portion is below a previously set value, the changing portion changes the transfer condition so that a current flowing through the transfer member is decreased.

6. The image forming apparatus according to claim 2, comprising a display portion that displays information, wherein when both of an absolute value of a current value detected by the first current detecting portion and an absolute value of a current value detected by the second current detecting portion are below a previously set value, abnormality is displayed on the display portion.

7. The image forming apparatus according to claim 2, comprising:

a toner replenishing portion that replenishes a developing device with toner; and a selecting portion that selects execution of the changing portion and execution of the toner replenishing portion.

8. The image forming apparatus according to claim 7, wherein when an absolute value of a current value detected by the first current detecting portion is below a previously set value, the changing portion changes a transfer condition so that a current flowing through the transfer member is increased, before the developing device is replenished with toner by the toner replenishing portion.

9. The image forming apparatus according to claim 7, wherein when an absolute value of a current value detected by the second current detecting portion is below a previously set value, the developing device is replenished with toner by the toner replenishing portion before the changing portion changes a transfer condition.

* * * * *